US010071834B2

(12) United States Patent
Lisek et al.

(10) Patent No.: US 10,071,834 B2
(45) Date of Patent: Sep. 11, 2018

(54) PAPER SACK

(71) Applicant: dy-pack Verpackungen Gustav Dyckerhoff GmbH, Wenden-Gerlingen (DE)

(72) Inventors: Eduard Lisek, Drolshagen (DE); Gerhard Schulte, Lindlar/Frielingsdorf (DE)

(73) Assignee: dy-pack Verpackungen Gustav Dyckerhoff GmbH, Wenden-Gerlingen (DE)

( * ) Notice: Subject to any disclaimer, the term of this patent is extended or adjusted under 35 U.S.C. 154(b) by 0 days.

(21) Appl. No.: 14/787,997

(22) PCT Filed: Apr. 10, 2014

(86) PCT No.: PCT/EP2014/000966

§ 371 (c)(1),
(2) Date: Oct. 29, 2015

(87) PCT Pub. No.: WO2014/177248

PCT Pub. Date: Nov. 6, 2014

(65) Prior Publication Data

US 2016/0083144 A1 Mar. 24, 2016

(30) Foreign Application Priority Data

Apr. 30, 2013 (DE) ..... 20 2013 004 058 U

(51) Int. Cl.
*B65D 33/01* (2006.01)
*B65D 30/18* (2006.01)
(Continued)

(52) U.S. Cl.
CPC ..... *B65D 31/08* (2013.01); *B65D 31/04* (2013.01); *B65D 31/14* (2013.01); *B65D 31/147* (2013.01); *B65D 33/01* (2013.01)

(58) Field of Classification Search
CPC ..... B65D 33/01; B65D 31/08; B65D 31/14; B65D 31/142; B65D 31/145; B65D 31/147
(Continued)

(56) References Cited

U.S. PATENT DOCUMENTS 3,085,737 A * 4/1963 Horton ..... B65D 33/01 383/101
3,309,006 A * 3/1967 Perry ..... B65D 33/01 383/100
(Continued)

FOREIGN PATENT DOCUMENTS

CN 2318153 Y 5/1999
CN 101132970 A 2/2008
(Continued)

OTHER PUBLICATIONS

Japanese Office Action dated Dec. 12, 2017.

*Primary Examiner* — Jes F Pascua
*Assistant Examiner* — Nina Attel
(74) *Attorney, Agent, or Firm* — Dilworth & Barrese, LLP

(57) ABSTRACT

The present invention relates to a paper sack for bulk material such as cement, gypsum, granulate, animal feed or similar, having a base, preferably a cross bottom or block bottom, and having an upper part which is disposed opposite the base and in which a valve hose is optionally arranged for filling the paper sack, wherein the paper sack has a coated paper layer, having a gas-tight coating facing the sack interior, wherein the coating forms the surface of the inner wall of the paper sack contacting the filling material, and wherein the coated paper layer has an overlap which is sealingly adhesively bonded toward the sack interior, and wherein the layer of the coated paper layer facing the sack interior has perforations in the region of the overlap which are covered by the layer of the coated paper layer facing the sack exterior.

15 Claims, 6 Drawing Sheets

(51) Int. Cl.
*B65D 30/24* (2006.01)
*B65D 30/08* (2006.01)

(58) Field of Classification Search
USPC ..... 383/100–103, 105, 107, 109, 113, 116
See application file for complete search history.

(56) References Cited

U.S. PATENT DOCUMENTS

| | | | | | |
|---|---|---|---|---|---|
| 4,411,358 | A * | 10/1983 | Bennwik | A61J 1/10 | 206/771 |
| 5,493,844 | A * | 2/1996 | Combrink | B65B 51/146 | 53/410 |
| 6,803,113 | B2 * | 10/2004 | Porter | B32B 7/12 | 156/229 |
| 2010/0158417 | A1 * | 6/2010 | Sharp | B32B 27/10 | 383/94 |

FOREIGN PATENT DOCUMENTS

| | | | |
|---|---|---|---|
| DE | 43 03 894 | A1 | 8/1994 |
| DE | 2002 00 332 | U1 | 5/2002 |
| EP | 1 858 769 | B1 | 10/2008 |
| EP | 2 100 821 | A1 | 9/2009 |
| JP | S48-086010 | U | 10/1973 |
| JP | S54-10415 | U | 1/1979 |
| JP | 2006-137450 | A | 6/2006 |
| JP | 2007-535447 | A | 12/2007 |

* cited by examiner

PAPER SACK

BACKGROUND OF THE INVENTION

The invention relates to a paper sack, preferably a valve paper sack, for bulk material such as cement, gypsum, granulate, animal feed or similar, having a base, preferably a cross bottom or block bottom, and having an upper part which is disposed opposite the base and in which a valve hose is optionally arranged for filling the paper sack.

Such paper sacks are known, for example, from EP 1 858 759 B1. The typical sizes 5 kg, 10 kg or 25 kg are in particular commercially widespread. They have one or more paper layers which are formed from paper or from a paper composite and/or from coated paper.

A valve hose is optionally provided for filling such sacks which is worked into the upper part and which is placed onto a filler nozzle for filling. A fast escaping of the air during the filling process is of material significance for a fast and economic filling. On the other hand, the sack should be as leakproof as possible after the filling. To achieve a greater product protection or a longer product stability of the filling material, a barrier layer can—as described in EP 1 858 769 B1—be interposed between an inner layer and an outer layer of paper.

It has been found that a sufficient product protection cannot be ensured with the already known sacks with sensitive filling materials. Such sensitive filling materials are, for example, fast-binding products in the sector of construction materials or foodstuffs in which a loss of aroma has to be prevented.

It has been found to be disadvantageous with already known sacks inter alia that the barrier layer was only interposed loosely overlapping so that a sufficient product protection was not possible or the product stability of the filling material was not sufficiently long. In addition, sack solutions have been found to be disadvantageous in which a further paper layer is arranged within the barrier layer because the residual moisture contained in the paper can diffuse into the filling material and thereby causes the latter to age faster or destroys it.

SUMMARY OF THE INVENTION

It is therefore the object of the present invention to provide an improved paper sack which in particular ensures an increased product protection and/or an extended product stability of the filling material and simultaneously allows an economic manufacture and fast venting on filling.

The object is achieved in accordance with the invention by a paper sack having the features herein. Advantageous embodiments result from the description herein.

The paper sacks in accordance with the invention have a coated paper layer having a coating facing the sack interior which is gas-tight, that is, which forms a good seal against gas passage, in particular against the passage of atmospheric oxygen, $CO_2$ or gaseous water. The coated paper layer furthermore has an overlap, with the overlapping margins preferably extending in parallel with the side margins of the paper sack so that the overlap extends from the base to the upper part in the manner of an overlap strip. With the paper sacks in accordance with the invention, the overlap of the coated paper layer is sealingly adhesively bonded toward the sack interior, i.e. the layer of the inner layer facing the sack interior is adhesively bonded to the layer of the coated paper layer facing the sack exterior in the region of the overlap and the adhesive bond is located toward the sack interior in the marginal region of the overlap. The adhesive bond is admittedly advantageous directly at the margin of the overlap, but the adhesive bond does not have to be located directly at the edge of the overlap toward the sack interior. It can rather also be moved away from the edge of the overlap since in this case the effect intended by the invention can also still be achieved. Further in accordance with the invention, the layer of the coated paper layer facing the sack interior has perforations in the region of the overlap which are covered by the layer of the overlap facing the sack exterior. Air can escape through these perforations on the filling of the sack and can escape toward the outer side of the overlap since the adhesive bond hindering the air flow is arranged toward the sack interior. The adhesive bond toward the sack interior thus as a directing effect for the air flow as well as a stabilization effect for the coated paper layer in the region of the overlap, that is, it serves the holding together of the material ends in the region of the overlap. It can thereby be achieved that the air exiting through the perforations on the filling exits the overlap region completely to the outside. Furthermore, the stability is improved in the overlap region and the leaktightness in the filled state. Furthermore, the spilling of filling material can be avoided by the overlap. It can be ensured by a suitable choice of the sizes of the perforation openings that the respective filling material is retained in the sack while the air escapes through the perforations. When the filling of the sack is complete, the perforations are covered by the outer layer of the inner layer in the region of the overlap so that the penetration of substances from the outside is avoided.

A good venting on the filling is achieved by the embodiment in accordance with the invention with a simultaneously large product protection and an extended product stability of the filling material. It is avoided by the gas-tight coating that atmospheric oxygen, $CO_2$ or gaseous water can penetrate from the outside in relevant quantities and can damage or destroy the filling material. These gases are namely primarily responsible for damage to sensitive products and for the smaller storage stability of such filling materials. Since the gas-tight coating forms the surface of the sack wall contacting the filling material, no paper layer is in contact with the filling material from which residual moisture could diffuse into the filling material.

An overlap region of a wider design allows a larger area of perforations in the overlap region and thus a better venting on filling. The higher material effort for the inner layer is disadvantageous with a larger overlap region. It has proved advantageous in the conflict of goals for the overlap of the inner layer to be at least 3% of the sack circumference, further advantageously at least 10% of the sack circumference and even further advantageously at least 17%, but at most 25%, of the sack circumference.

In another preferred embodiment, the gas-tight coating has a multi-layer structure. The coating preferably comprises a metalized film and/or a metal film. A particular good gas-tightness can be achieved by such metalized films or metal films. Aluminum is very well suited as a metallic material. The metallic gas barrier provides a particularly good aroma protection in the food area.

The gas-tight coating advantageously also forms a barrier for liquids so that a sealing against the ingress of water is also achieved.

In another preferred embodiment, the perforations are formed by needling and/or one or more slits on the inner side or in the inner layer of the overlap. In another variant, the perforations are formed as microperforations which are established, for example, in an electric or chemical manner and are known from cigarette paper.

In another preferred embodiment, adhesive bonds are additionally present in a middle region and/or in the marginal region of the overlap toward the sack exterior. These adhesive bonds further stabilize the overlap region. These adhesive bonds are formed as permeable toward the sack exterior, advantageously by interrupted adhesive lines along the edge of the overlap toward the sack exterior.

In a further preferred embodiment, the paper sack has a plurality of overlaps in accordance with the invention, particularly preferably an overlap in accordance with the invention on the front side of the sack and a further overlap in accordance with the invention on the rear side of the sack. The venting of the sack can thus be improved on the filling and can be distributed over both sides.

In other preferred embodiments, the paper sack in accordance with the invention has further paper layers or layers of other materials suitable for sack manufacture outside the coated paper layer. These layers must also be configured such that they allow the air to escape to the outside on the filling. Paper, coated paper, film and/or coated film can be considered as materials suitable for sack manufacture.

BRIEF DESCRIPTION OF THE DRAWINGS

Embodiments of the invention will be explained in more detail with reference to the following Figures. There are shown:

FIG. 2*b*: the inwardly disposed coated paper layer 20 of the sack in accordance with FIG. 1, with an enlarged detail of the overlap 22 with the adhesive bond 24;

DESCRIPTION OF THE PREFERRED EMBODIMENTS

Figure 1:
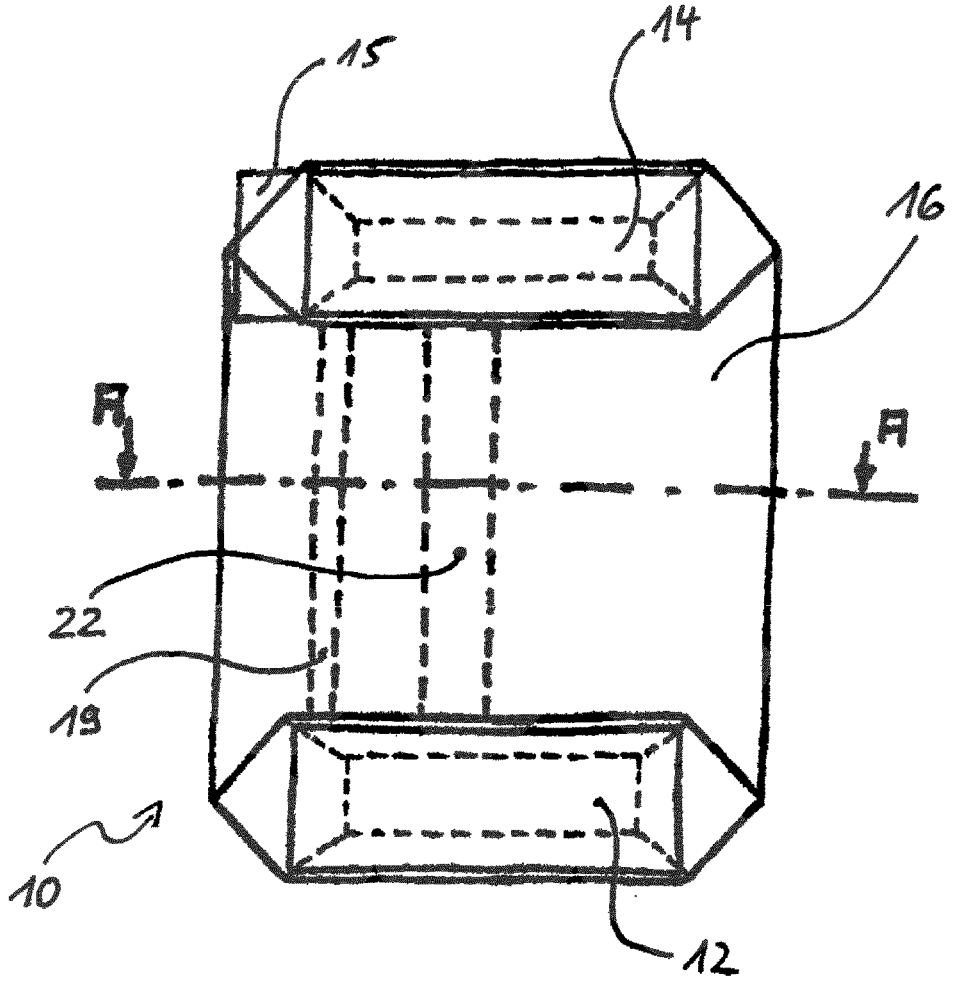
FIG. 1: a schematic plan view of a valve sack in accordance with the invention with a base and an upper part.

FIG. 1 shows a paper sack 10 in accordance with the invention having a cross bottom 12 and an upper part 14, wherein the base 12 and the upper part 14 are folded toward the front side 16 of the paper sack 10. In this respect, the rear side of the sack which lies beneath the front side 16 cannot be seen. A valve hose 15 is inserted in the upper part 14.

Figure 2A:
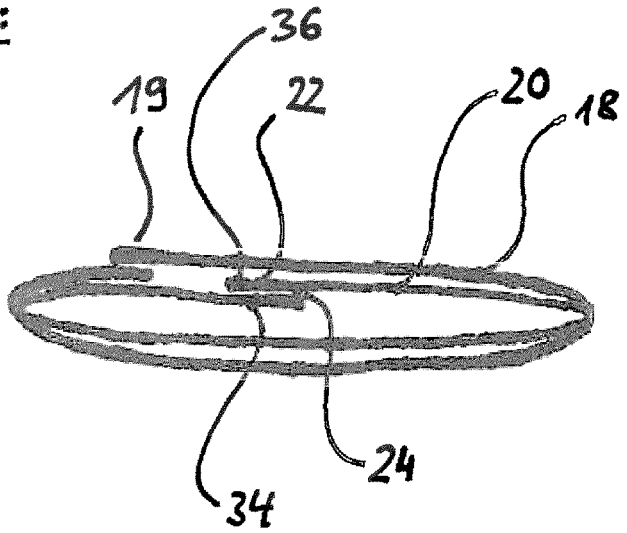
FIG. 2*a*: a schematic cross-section through the sack in accordance with the invention in accordance with FIG. 1, along the line A-A of FIG. 1.
Figure 26:
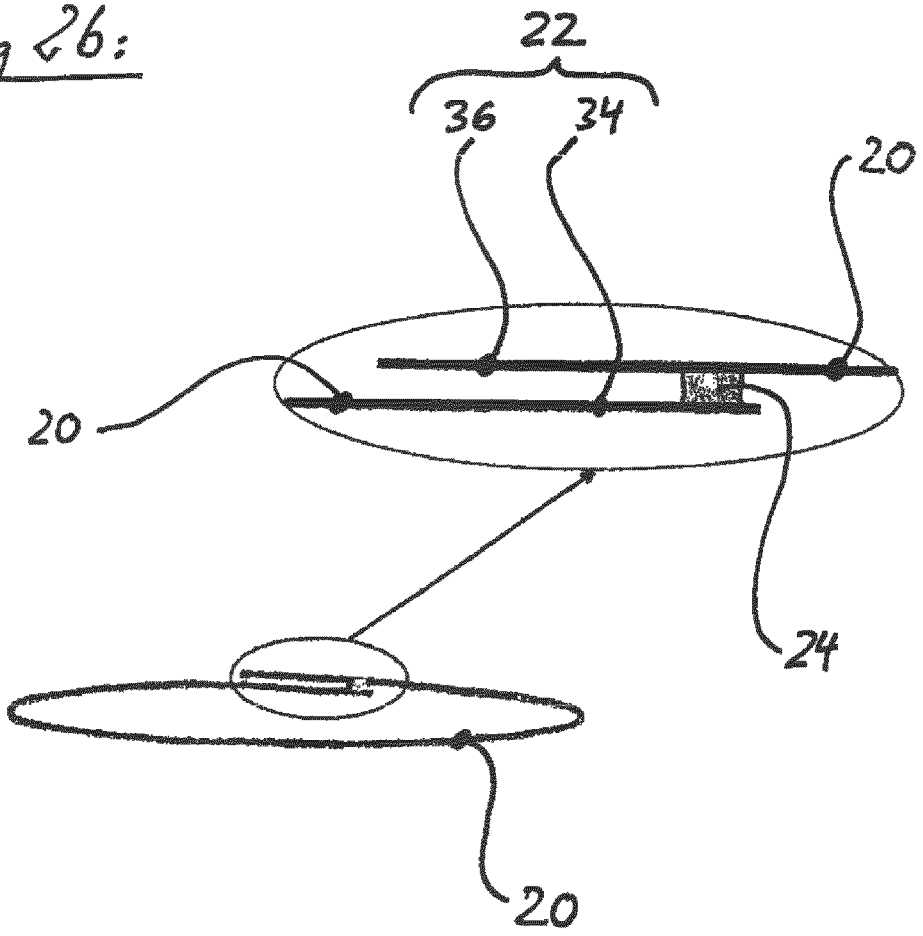

This paper sack is manufactured, as in particular the cross-section in accordance with FIG. 2*a* shows, from an inwardly disposed coated paper layer 20 and from an outer layer 18 of paper or of a paper composite. The overlap 19 of the outer layer is kept narrow and is adhesively bonded so that the outer layer forms a hose section between the base 12 and the upper part 14. The overlap 22 of the inwardly disposed coated paper layer 20 is formed wider and is adhesively bonded by the adhesive bond 24 toward the sack interior. The coated paper layer 20 likewise forms a hose section between the base 12 and the upper part 14, at which hose section the overlap 22 extends as a strip from the base 12 to the upper part 14.

FIG. 2*b* shows the inwardly disposed coated paper layer 20 with an enlarged detail of the overlap 22. The layer 34 of the coated paper layer 20 facing the sack interior overlaps with the outwardly facing layer 36 of the coated layer 20 in the region of the overlap 22. The overlap 22 is sealingly adhesively bonded by means of the adhesive bond 24 at its margin facing the sack interior.

Figure 2C:
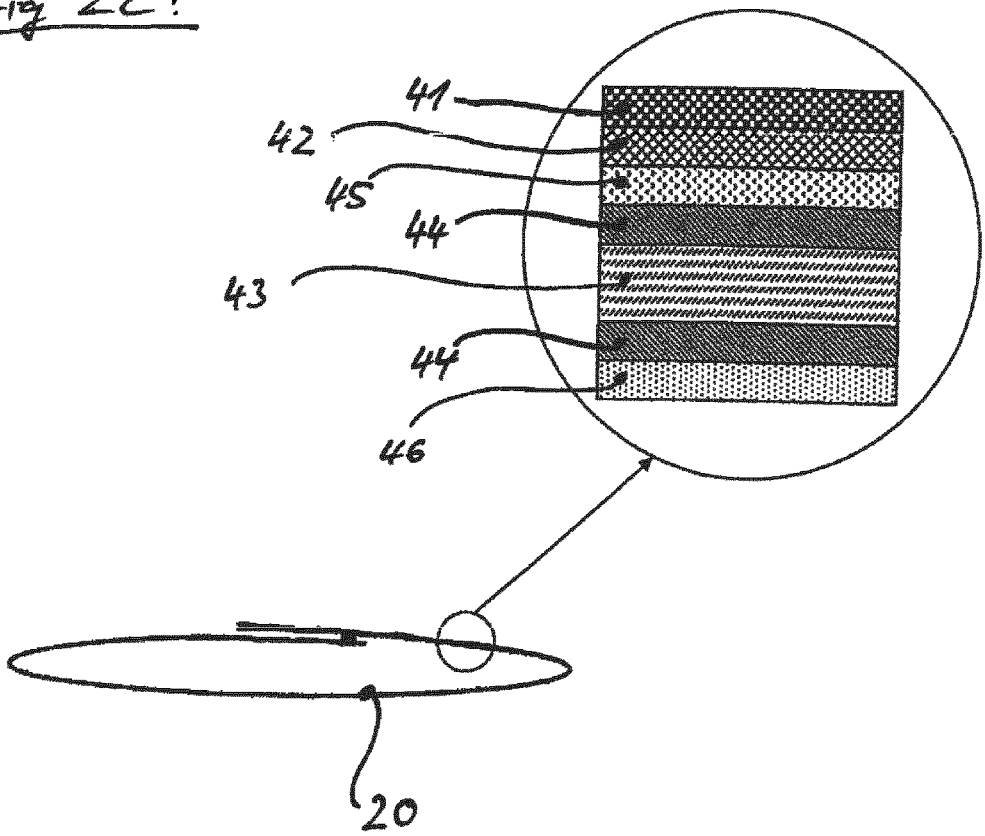
FIG. 2*c*: the inwardly disposed coated paper layer 20 with an enlarged detail of the layer structure.

FIG. 2*c* shows the layer structure of the inwardly disposed coated paper layer 20. The coated paper layer 20 has a carrier layer 41 of paper at its outer side. A metalization layer 42, which is preferably formed from aluminum, follows inwardly as the next layer. The metallization layer 42 is protected by a plastic coating whose core 43 comprises PET (polyethylene terephthalate) or comparable plastics. The core 43 is provided at both sides with a surface layer or a surface treatment 44. A lacquer layer 45 is located between the metallization layer 42 and the surface treatment 44. A corona pre-treatment 46, which then forms the innermost layer toward the sack interior, is present on the outer surface treatment 44. The plastic coating applied to the metallic gas barrier protects the metal layer from damage on the sack manufacture.

Figure 3:
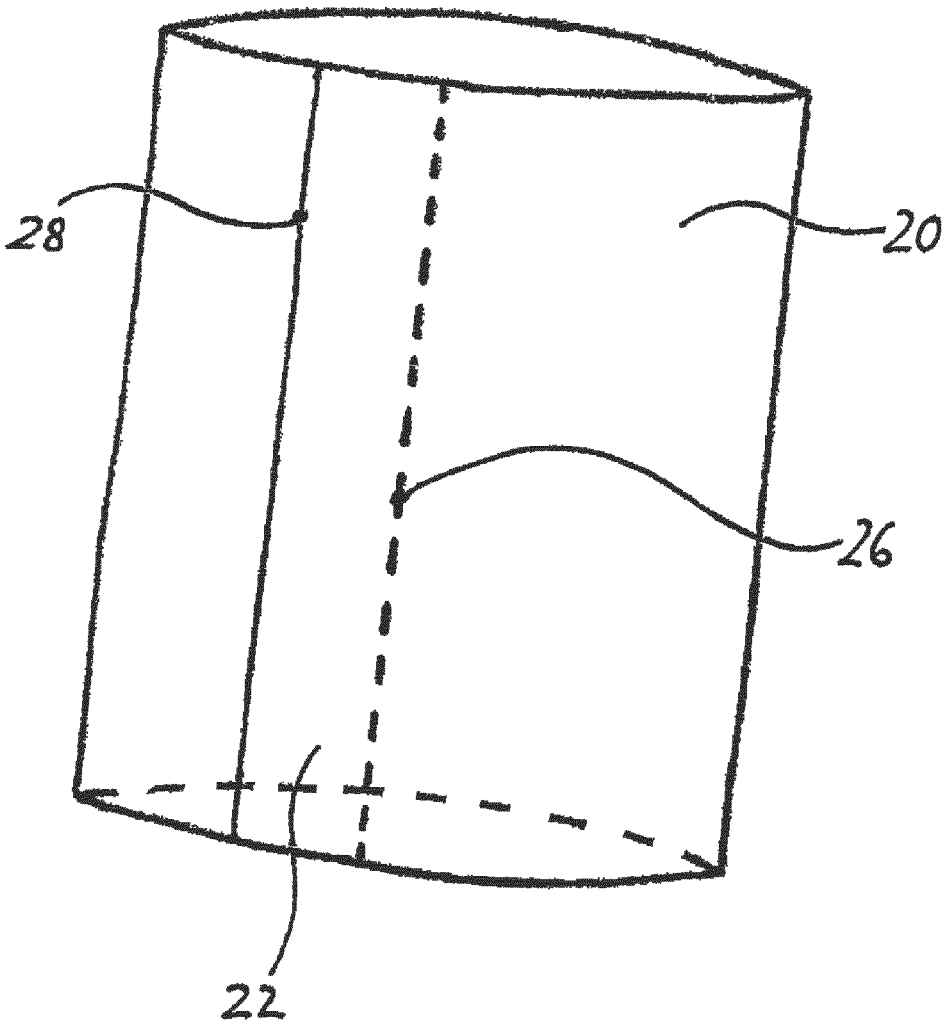
FIG. 3: a hose section of the coated paper layer 20 of a sack in accordance with the invention.

FIG. 3 shows a schematic plan view of the hose section of the coated paper layer 20. The overlap 22 of the paper layer 20 is bounded toward the sack interior by the inner edge 26 and toward the sack exterior by the outer edge 28.

Figure 4:
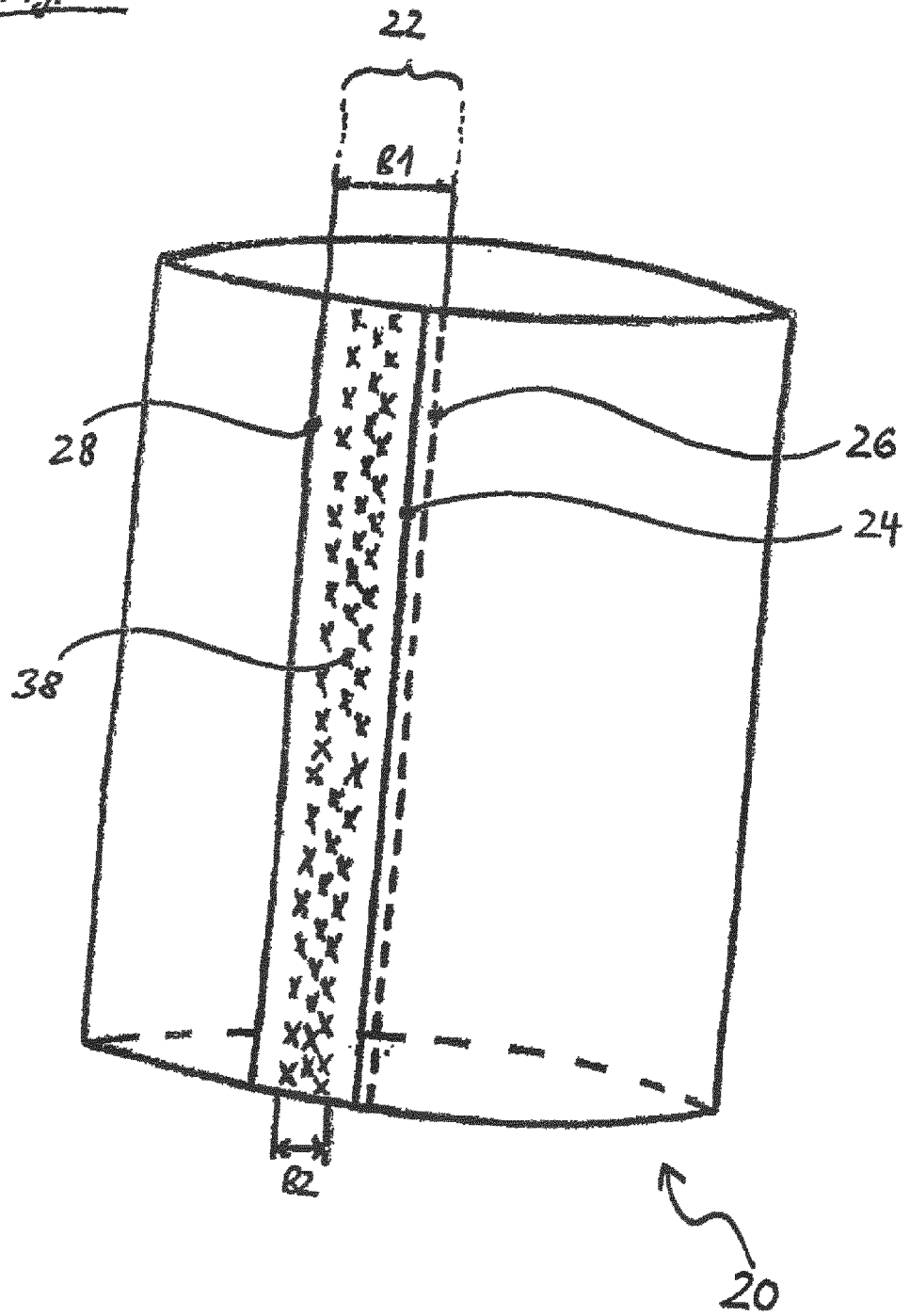
FIG. 4: a hose section of the coated paper layer 20 of a valve sack in accordance with a first embodiment of the invention.

FIG. 4 shows the embodiment of the overlap region 22 of the paper layer 20 in accordance with a first embodiment of the invention. The overlap region is sealingly adhesively bonded with a continuous adhesive line 24 toward the sack interior beside the inner edge 26 of the overlap. The outer edge 28 of the overlap is loose, i.e. not adhesively bonded, toward the sack exterior. The layer 34 of the paper layer 20 facing the sack interior is perforated in the region of the overlap 22. The perforation 38, which is shown by crosses in FIG. 4, extends in the same manner as the overlap as a strip from the base 12 to the upper part 14. The width B2 of the perforation strip advantageously amounts to approximately half the width B1 of the overlap strip 20. The layer 36 of the paper layer 20 facing the sack exterior does not have any perforations in the overlap region. The perforations 38 are thereby covered.

Figure 5:
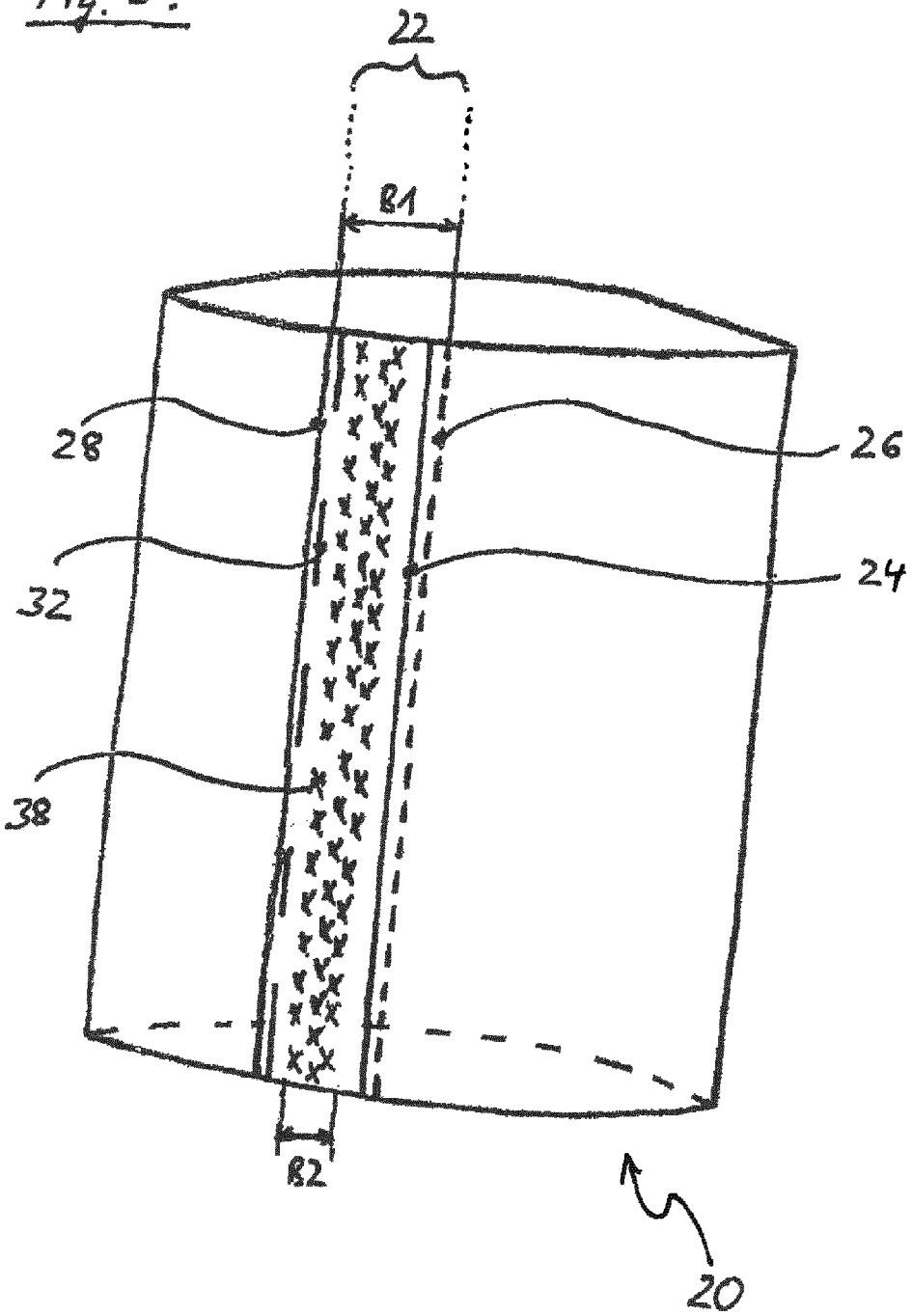
FIG. 5: a hose section of the coated paper layer 20 of a valve sack in accordance with a second embodiment of the invention.

In the embodiment in accordance with FIG. 5, the overlap along the outer edge 28 is adhesively bonded with an interrupted adhesive line 32. The overlap is thereby stabilized at the outer edge 28.

A number of advantages are achieved with the invention. The paper sack can in particular be well-vented on the filling and a great product protection as well as an extended product stability of the filling material is achieved by the gas-tight coating at the inner side of the sack and by the covering of the venting perforations in the filled sack. In addition, the manufacture of the sack is simplified with respect to the prior art of EP 1 858 769 B1 since no separate barrier layer has to be inserted between two paper layers.

The invention claimed is:

1. The paper sack (10) for bulk material such as cement, gypsum, granulate, animal feed or similar, comprising a cross bottom or block bottom base (12), and a cross bottom or block bottom upper part (14) disposed opposite the base (12), wherein the paper sack has a coated paper layer (20) having a gas-tight coating (42, 43, 44, 45, 46) facing a sack interior, the gas-tight coating forms a surface of an inner wall of the paper sack contacting the filling material, the coated paper layer (20) has an overlap (22) continuously sealingly adhesively bonded (24) toward the sack interior, a layer (34) of the coated paper layer (20) facing the sack interior has perforations (38) in the region of the overlap (22), wherein the perforations are covered by a layer (36) of the coated paper layer facing a sack exterior, the overlap (22) of the coated paper layer (20) has additional adhesive bonds (32) in a middle region and/or in the region of its margin toward the sack exterior, the additional adhesive bonds extending along a single line between the base (12) and upper part (14), and interrupted at intervals to be permeable toward the sack exterior, one or more further material layers (18) are present as a sheath around the coated paper layer (20), which further material layers (18) are configured to allow air to escape to the outside during filling of the paper sack and formed from material suitable for sack manufacture, with said at least one further layer (18) composed of paper or paper composite and overlapping (19) itself, the overlap (22) of the coated paper layer (20) wider than the overlap (19) of said at least one further layer (18), and the overlap (19) of said at least one further layer (18) adhesively bonded along a line between the base (12) and upper part (14) such that the at least one further layer (18) forms a hose section between the base (12) and upper part (14) and the coated paper layer (20) forms a hose section between the base (12) and upper part (14).

2. The paper sack in accordance with claim 1, wherein the overlap of the coated paper layer is at least 3% of the sack circumference.

3. The paper sack in accordance with claim 2, wherein the overlap of the coated paper layer is at least 10% of the sack circumference.

4. The paper sack in accordance with claim 3, wherein the overlap of the coated paper layer is at least 17% to a maximum of 25% of the sack circumference.

5. The paper sack in accordance with claim 1, wherein the gas-tight coating (42, 43, 44, 45, 46) of the coated paper layer (20) has a multi-layer structure.

6. The paper sack in accordance with claim 1, wherein the gas-tight coating of the coated paper layer comprises a metalized film and/or a metal film.

7. The paper sack in accordance with claim 1, wherein the perforations (38) in the layer (34) of the coated paper layer (20) facing the sack interior are formed by needling and/or by one or more slits.

8. The paper sack in accordance with claim 1, wherein the gas-tight coating (42, 43, 44, 45, 46) entirely circumferentially faces and encompasses the sack interior.

9. The paper sack in accordance with claim 1, wherein a width (B2) of a strip of the coated paper layer (20) having the perforations (38) is approximately half a width (B1) of the overlap (22).

10. The paper sack in accordance with claim 1, additionally comprising a valve hose (15) inserted into the upper part (14).

11. The paper sack in accordance with claim 1, wherein the layer (36) of the coated paper layer (20) facing the sack exterior does not have any perforations in the region of the overlap (22).

12. The paper sack in accordance with claim 1, wherein the further material layers are formed from paper, coated paper, film and/or coated film.

13. The paper sack in accordance with claim 1, wherein said overlap (19) of said at least one further material layer (18) is spaced away from an end of the overlap (22) of the coated paper layer (20) having said interrupted adhesive bonds (32).

14. The paper sack (10) for bulk material such as cement, gypsum, granulate, animal feed or similar, comprising a cross bottom or block bottom base (12), and a cross bottom or block bottom upper part (14) disposed opposite the base (12), wherein the paper sack has a coated paper layer (20) having a gas-tight coating (42, 43, 44, 45, 46) facing the sack interior, the gas-tight coating forms a surface of an inner wall of the paper sack contacting the filling material, the coated paper layer (20) has an overlap (22) continuously sealingly adhesively bonded (24) toward the sack interior, a layer (34) of the coated paper layer (20) facing the sack interior has perforations (38) in the region of the overlap (22), wherein the perforations are covered by a layer (36) of the coated paper layer facing a sack exterior, the overlap (22) of the coated paper layer (20) has additional adhesive bonds (32) in a middle region and/or in the region of its margin toward the sack exterior, the additional adhesive bonds extending along a single line between the base (12) and upper part (14), and interrupted at intervals to be permeable toward the sack exterior, the coated paper layer (20) comprises (i) a paper carrier layer (41) situated along an outermost side thereof facing the sack exterior, and (ii) the gas-tight coating, wherein the gas-tight coating comprises (i) a metallization layer (42) situated inwardly against the paper carrier layer (41), and (ii) a plastic coating situated inwardly of the metallization layer (42), wherein the plastic coating comprises (i) a plastic core (43), (ii) a surface layer or treatment (44) on both sides of the plastic core (43), (iii) a lacquer layer (45) situated against the metallization layer (42) and one of the surface layers or treatments (44), and (iv) a corona pre-treatment (46) situated against the other surface treatment or layer (44) and forming an innermost layer facing the sack interior, and additionally comprising a valve hose (15) inserted into the upper part (14) thereof.

15. The paper sack in accordance with claim 14, wherein the paper sack has a separate outer circumferential layer (18) of paper or paper composite encompassing the coated paper layer (20).

* * * * *